US005757391A

United States Patent [19]

Hoisington

[11] Patent Number: 5,757,391

[45] Date of Patent: May 26, 1998

[54] HIGH-FREQUENCY DROP-ON-DEMAND INK JET SYSTEM

[75] Inventor: Paul A. Hoisington, Norwich, Vt.

[73] Assignee: Spectra, Inc., Keene, N.H.

[21] Appl. No.: 638,316

[22] Filed: Apr. 26, 1996

Related U.S. Application Data

[63] Continuation of Ser. No. 277,101, Jul. 20, 1994, abandoned.

[51] Int. Cl.[6] ..... B41J 2/04

[52] U.S. Cl. ..... 347/11; 347/88

[58] Field of Search ..... 347/10, 11, 9, 347/15, 88, 68, 70

[56] References Cited

U.S. PATENT DOCUMENTS

| | | | |
|---|---|---|---|
| 3,683,212 | 8/1972 | Zoltan | 347/68 X |
| 4,233,610 | 11/1980 | Fischbeck | 347/94 |
| 4,459,601 | 7/1984 | Howkins | 347/68 X |
| 4,471,363 | 9/1984 | Hanaoka | 347/10 |
| 4,475,113 | 10/1984 | Lee | 347/47 |
| 4,498,089 | 2/1985 | Scardovi | 347/10 |
| 4,563,689 | 1/1986 | Murakami | 347/11 |
| 4,697,193 | 9/1987 | Howkins | 347/9 |
| 4,716,418 | 12/1987 | Heinzl | 347/11 |
| 4,779,099 | 10/1988 | Lewis | 347/20 |
| 4,998,120 | 3/1991 | Koto | 347/88 X |
| 5,043,741 | 8/1991 | Spehrley | 347/88 X |
| 5,170,177 | 12/1992 | Stanley | 347/11 |
| 5,182,572 | 1/1993 | Merritt | 347/88 X |
| 5,202,659 | 4/1993 | DeBonte | 347/15 |
| 5,264,865 | 11/1993 | Shimoda | 347/11 |
| 5,426,454 | 6/1995 | Hosono | 347/9 |
| 5,495,270 | 2/1996 | Burr | 347/10 |

FOREIGN PATENT DOCUMENTS

| | | | |
|---|---|---|---|
| 271905A2 | 4/1988 | European Pat. Off. | B41J 3/04 |
| 63-094853 | 8/1988 | Japan | B41J 3/04 |
| 01278357 | 11/1989 | Japan | B41J 3/04 |
| 06155737 | 3/1994 | Japan | B41J 2/045 |

OTHER PUBLICATIONS

Peter A. Torpey, "Effect of Refill Dynamics on Frequency Response and Print Quality in a Drop–on–Demand Ink–Jet System", *The Third International Congress on Advances in Non–Impact Printing Technologies*, SPSE, Aug. 24–28, 1986, pp. 89–91.

*Primary Examiner*—Joseph W. Hartary
*Attorney, Agent, or Firm*—Baker & Botts

[57] ABSTRACT

In the high-frequency drop-on-demand ink jet system described in the specification, a variable impedance characteristic of an ink jet orifice is utilized to provide maximum drop ejection rates exceeding the maximum rates possible with constant orifice impedance characteristics. In one embodiment, successive negative, positive and negative pulses are applied to eject each drop in order to utilize a nonlinear orifice impedance characteristic, permitting maximum ink drop ejection rates exceeding 10–20 kHz and up to 150–200 kHz, and, in another embodiment, the ink jet orifice is designed with a bellmouth shape arranged to enhance the variable impedance characteristic.

14 Claims, 2 Drawing Sheets

HIGH-FREQUENCY DROP-ON-DEMAND INK JET SYSTEM

This application is a continuation of application Ser. No. 08/277,101, filed on Jul. 20, 1994 now abandoned.

BACKGROUND OF THE INVENTION

This invention relates to drop-on-demand ink jet systems and, more particularly, to an improved drop-on-demand ink jet system operable at high drop-ejection rates.

In recent years, ink jet systems providing high-resolution images, i.e., more than 300 dots per inch, have been developed. In such high-resolution systems, the ink drops are not only more closely spaced in the image, but also are smaller in volume. Consequently, a larger number of drops must be ejected by the ink jet head to produce the same size image and, unless the drops can be ejected at a higher rate, the printing operation must be slower than for a lower-resolution system producing the same image.

Conventional drop-on-demand ink jet heads, however, have an upper limit on the rate at which drops can be ejected through each ink jet orifice which is dependent upon the orifice size and the characteristics of the ink. With the smaller-size drops produced in high-resolution drop-on-demand ink jet systems, the image printing rate is limited by the maximum drop ejection rate.

As described, for example, in the Fischbeck et al. U.S. Pat. No. 4,233,610 and in the paper by Peter A. Torpey entitled "*Effect of Refill Dynamics on Frequency Response and Print Quality in a Drop-on-Demand Ink-Jet System*" published in the *Third International Nonimpact Printing Symposium* of the SPSE, the maximum rate at which a drop-on-demand ink jet printer may be operated is limited by the time required to replenish the ink in each ink jet orifice after a drop of ink has been ejected from the orifice.

It has generally been taught that drop-on-demand ink jet orifices are refilled after drop ejection as a result of the negative pressure generated by surface tension within the orifice. In hot melt ink jet systems, it is desirable to be able to use ink having a high viscosity, which reduces ink flow rates and increases the orifice refill time.

SUMMARY OF THE INVENTION

Accordingly, it is an object of the present invention to provide a new and improved drop-on-demand ink jet system which overcomes the disadvantages of the prior art.

Another object of the invention is to provide a drop-on-demand ink jet system capable of printing at a rate higher than a conventional ink jet system designed to produce the same resolution with the same kind of ink.

These and other objects of the invention are attained by utilizing variable orifice impedance characteristics, which are dependent upon the quantity of ink within the orifice and the shape of the orifice, to pump ink into the orifice following drop ejection so as to permit a high ink drop ejection rate.

The use of variable orifice impedance characteristics permits maximum orifice refill rates which may be from one to two orders of magnitude higher than refill rates obtainable based on constant orifice impedance characteristics. The desired variable orifice impedance characteristic may be achieved by controlling the position of the ink meniscus in the orifice during operation alone or in combination with an appropriately-shaped orifice. With a variable orifice impedance characteristic, the pressure which draws ink from the reservoir and the pressure chamber into the orifice may be increased, causing the orifice to be refilled more rapidly after each ink drop ejection, thereby permitting drops to be ejected more frequently. By utilizing variable orifice impedance, the maximum orifice refill rate can be increased, permitting printing of images having a very high resolution, such as 600 to 2400 dots per inch, at a rate which is one to two orders of magnitude higher than printing rates which could be achieved with constant impedance orifices, providing maximum ink drop ejection rates of from 10 to 20 kHz up to 150 to 200 kHz, for example. In one embodiment, the orifice has a tapered shape such as a bellmouth shape designed to enhance the variable impedance characteristics resulting from changes in the amount of ink in the orifice during operation.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
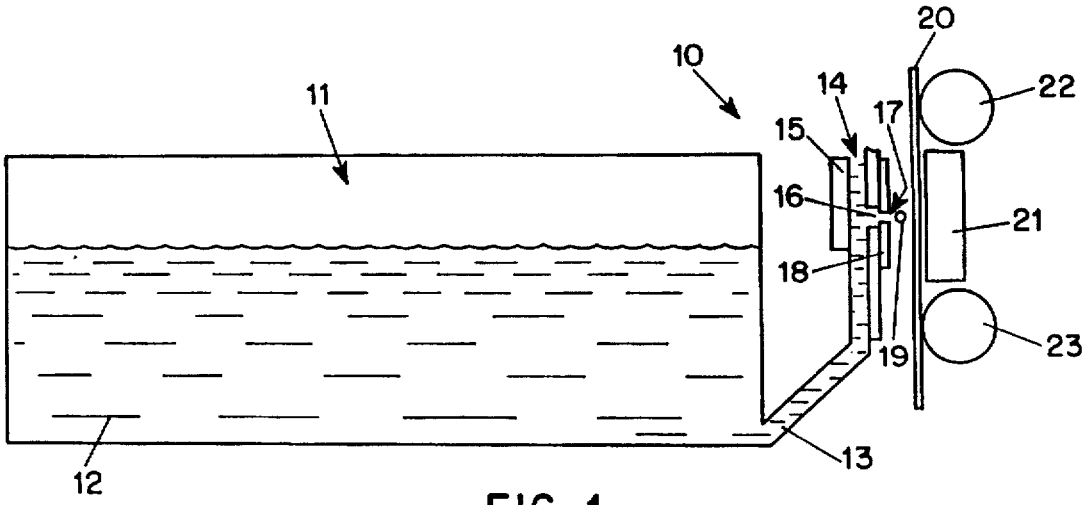
FIG. 1 is a schematic view in longitudinal section illustrating a representative drop-on-demand ink jet head.
Figure 2:
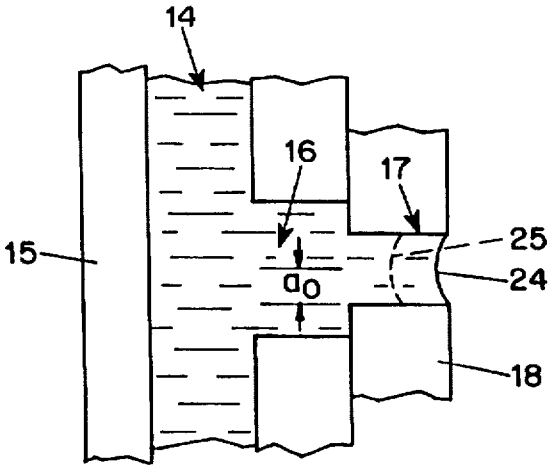
FIG. 2 is an enlarged schematic fragmentary view illustrating a conventional orifice structure for the ink jet head of FIG. 1.

In the typical embodiment of an ink jet system shown schematically in FIGS. 1 and 2, an ink jet head 10 includes a reservoir 11 containing a supply of ink 12 and a passage 13 leading from the reservoir to a pressure chamber 14. A transducer 15 forming one wall of the pressure chamber is arranged to be actuated on demand to force ink from the chamber 14 through a passage 16 leading to an orifice 17 in an orifice plate 18, causing a drop of ink 19 to be ejected from the orifice 17. During such operation, the ink jet head 10 is scanned in a direction perpendicular to the plane of FIG. 1 adjacent to a substrate 20 such as a sheet of paper supported on a platen 21 and movable between two drive rolls 22 and 23 in the direction perpendicular to the direction of motion of the head. By selective ejection of drops from an array of orifices 17 in the orifice plate 18 as the ink jet head 10 is scanned adjacent to the substrate 20, and by moving the substrate perpendicularly to the scanning direction, an image having a desired configuration is produced on the substrate in a conventional manner.

Figure 3:
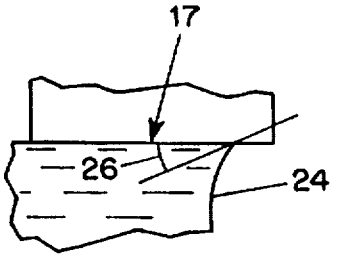
FIG. 3 is an enlarged fragmentary view of the arrangement shown in FIG. 2 illustrating the contact angle of the ink meniscus in the orifice passageway.

Referring to FIG. 2, which is an enlarged fragmentary view schematically illustrating the pressure chamber, the passage 16 and the orifice 17 of the ink jet head, the position 24 of the ink meniscus in the orifice 17 immediately prior to ejection of an ink drop 19 is normally at the outer end of the orifice and the position 25 of the meniscus immediately after drop ejection is spaced from the outer end of the orifice by a distance corresponding to the volume of the drop of ink which has been ejected. The maximum refill pressure $P_{refill}$ in the ink which causes ink flow in the orifice to produce a replacement of the drop volume in the orifice is dependent upon the angle 26, shown in FIG. 3, between the meniscus 24 and the wall of the orifice 17, which is, in turn, dependent upon the surface tension of the ink and upon the orifice radius $a_0$ in accordance with the following equation:

$$P_{refill} = \frac{2\sigma}{a_0} \tag{1}$$

where $\sigma$ is the surface tension of the ink and $a_0$ is the orifice radius. In practice, the average orifice refill pressure $P_{refill}$ is considerably less than the maximum value represented by Equation (1).

The rate of flow of ink into the orifice 17 as a result of the refill pressure $P_{refill}$ is determined by the resistance within the orifice 17 and in the ink passages 13 and 16 and in the pressure chamber 14 in the path between the reservoir 12 and the orifice 17. The orifice resistance $R_0$ is given by the equation:

$$R_0 = \frac{8\mu l_0}{\pi a_0^4} \tag{2}$$

where $\mu$ is the ink viscosity and $l_0$ is the fluidic length of the orifice. Consequently, the maximum ink flow rate $Q_{max}$ available to refill the orifice is given by the following equation:

$$Q_{max} = \frac{P_{refill}}{R_{system}} \tag{3}$$

where $R_{system}$ is the total resistance between the ink reservoir and the outlet end of the orifice. Since $R_{system}$ is greater than the orifice resistance $R_0$, the upper limit on the refill flow rate for a constant orifice impedance characteristic is:

$$Q_{max} = \frac{P_{refill}}{R_0} = \frac{\pi a_0^3 \sigma}{4\mu l_0} \tag{4}$$

and the maximum drop ejection frequency for each orifice is the maximum refill flow rate $Q_{max}$ divided by the drop volume, i.e.:

$$f_{max} = \frac{Q_{max}}{V_d} = \frac{\pi a_0^3 \sigma}{4\mu l_0 V_d} \tag{5}$$

Figure 4:
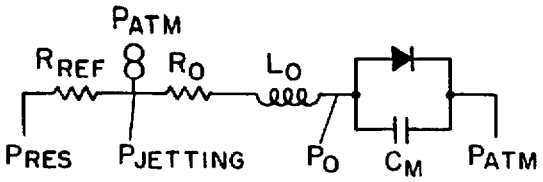
FIG. 4 is a schematic equivalent electrical circuit diagram showing the fluidic pressures, resistances and inertances for a constant impedance orifice arrangement.

FIG. 4 is a schematic electrical circuit diagram illustrating the equivalent electrical circuit for the ink flowpath between the ink reservoir and the outer end of the orifice for an ink jet system having a constant orifice impedance characteristic. In that diagram, $P_{res}$ is the pressure of the ink in the reservoir, $R_{ref}$ is the refill resistance of the ink flowpath leading to the orifice, $P_{atm}$ is the atmospheric pressure, defined as zero pressure, $P_{jetting}$ is the pressure applied to eject ink from the orifice, $R_0$ is the fluidic resistance of the orifice, $L_0$ is the fluidic inertance of the orifice, $P_0$ is the orifice refill pressure, i.e., the pressure at the inner surface of the ink meniscus in the orifice, which is the pressure produced by the surface tension between the ink and the orifice wall, and $C_m$ is the capacitance of the meniscus. The following calculation of the maximum operating frequency of the orifice assumes that $P_{res}$ is constant and slightly negative, that the maximum negative pressure $P_0$ is $2\sigma/a_0$, and that the system is linear.

In a typical hot melt drop-on-demand ink jet system designed for high resolution, $a_0$ is $28\times10^{-6}$ meters, $\sigma$ is 0.028 Newtons/m, $\mu$ is 0.025 Pascal/sec., $l_0$ is $30\times10^{-6}$ meters, and $V_d$ is $0.95\times10^{-13}$ $m^3$. Substituting those values in Equation (5) gives a maximum drop ejection frequency of 6775 Hz. If the ink passages 13 and 14 leading from the reservoir 11 to the orifice 17 have a flow resistance $R_{ref}$ which is approximately equal to that of the orifice, the maximum operating frequency of the ink jet head would be approximately half that given by Equation (5), or about 3300 Hz. At a resolution of 300 dots/inch, this maximum operating frequency based on a constant orifice impedance requires approximately 1 second to print an 11-inch line and, for a resolution of 600 dots/inch, which is a current high-resolution standard, requires about twice as long, assuming the same orifice refill time, which implies the same orifice diameter. For very high-resolution operation, up to 2400 dots/inch, the printing time would be substantially greater.

In accordance with one aspect of the invention, variable orifice impedance characteristics are utilized to provide orifice refill rates greater than those of constant impedance orifices and correspondingly higher drop ejection frequencies by controlling the manner in which pressure is applied to the ink in the orifice during the ink drop ejection pressure pulse. In particular, the drop ejection pressure pulse has a negative pressure component applied when the orifice impedance is high, and a positive pressure component which is applied when the orifice impedance is low, so that there is a significant difference in the orifice impedance during the periods of application of the different pressure pulse portions. Moreover, the pressure pulses are applied for time durations which are not excessively long compared with the inertance/resistance ratio of the orifice.

Figure 5:
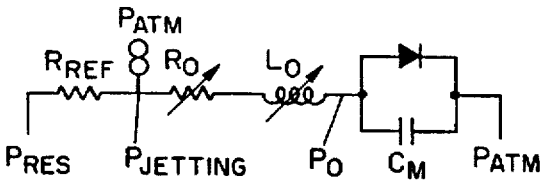
FIG. 5 is a schematic equivalent electrical circuit diagram showing the fluidic pressures, resistances and inertances for a variable impedance orifice arrangement.

FIG. 5 shows the equivalent electrical circuit diagram for an ink jet system utilizing a variable orifice impedance characteristic. As will be apparent from a comparison with FIG. 4, this circuit diagram has variable orifice resistance and orifice inertance, but otherwise is the same as that of FIG. 4.

Figure 6:
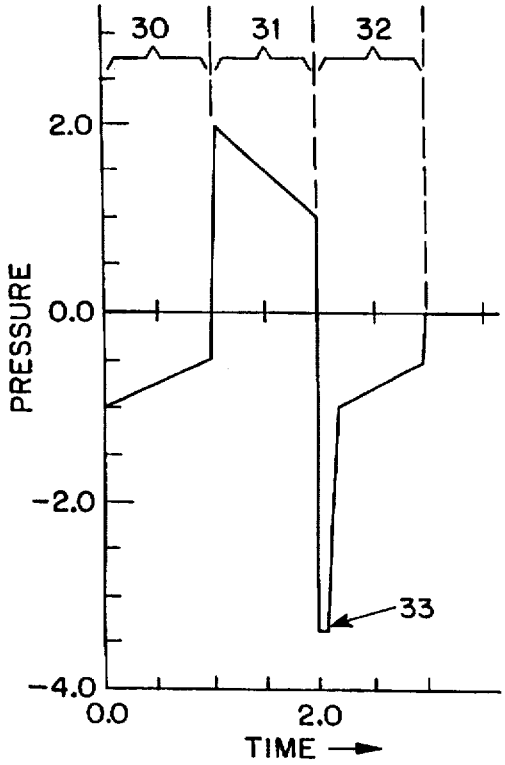
FIG. 6 is a graphical representation showing a representative drop ejection pressure pulse waveform arranged to utilize variable orifice impedance characteristics so as to produce a high operating frequency and a correspondingly high drop ejection rate.

Utilization of variable orifice impedance characteristics in accordance with the invention may be effected by controlling the position of the ink meniscus within the orifice in such a way that the impedance is reduced during drop ejection, thereby permitting higher drop ejection rates. This is a consequence of a surprising attribute of a system with variable orifice impedance, i.e. a positive flow of ink through the orifice can be created as a result of a pressure waveform which is negative when averaged over time. FIG. 6 illustrates a representative pressure pulse waveform capable of producing a high drop ejection rate, and FIG. 7 illustrates the ink flow within the orifice during the application of that pulse, while FIG. 8 represents the relative proportion of the orifice volume containing ink during the application of the drop ejection pulse.

The typical pressure pulse utilizing variable impedance characteristics of an orifice shown in FIG. 6 commences with application of negative pressure during a first time period 30, followed by application of positive pressure having about twice the magnitude of the negative pressure during a second time period 31, after which negative pressure of a magnitude similar to that applied during the time period 30 is applied during a time period 32, and thereafter the pressure is restored to zero.

During each of these time periods, as shown by the sloping pulse lines, the absolute value of the applied pressure decreases at a rate dependent on the magnitude of the initially-applied pressure to a pressure which is approximately half that of the initially-applied pressure during that time period. At the beginning of the third time period 32, however, a negative pressure spike 33 having a peak value approximately three times that of the initial negative pressure is applied for a very short time period for the purpose of inducing drop break-off.

Figure 7:
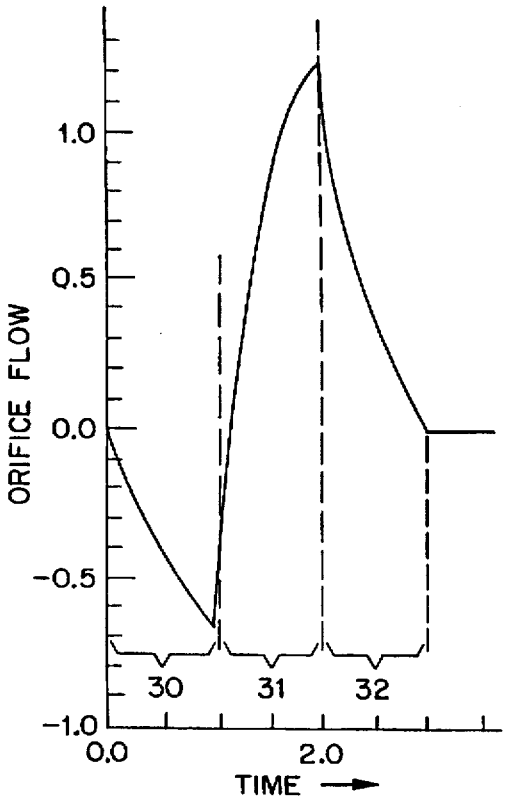
FIG. 7 is a graphical representation showing the ink flow within the orifice during application of the pulse shown in FIG. 6.
Figure 8:
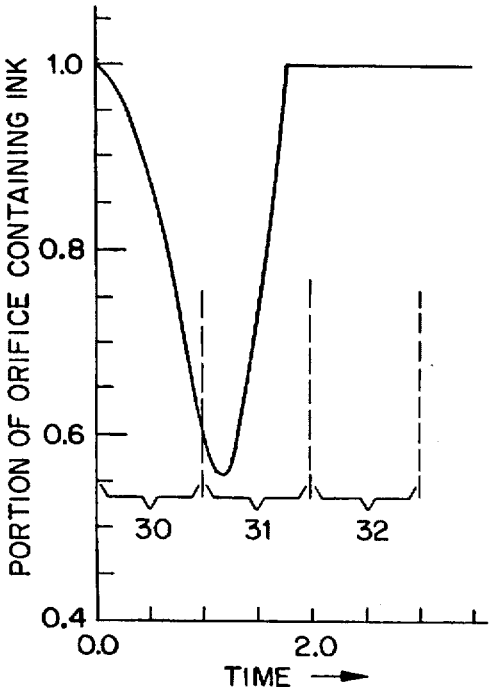
FIG. 8 is a graphical representation illustrating the relative proportion of the total orifice volume containing ink during the application of the pulse shown in FIG. 6.

As shown in FIG. 7, the resulting flow of ink in the orifice is in the inward direction during the time period 30, retracting the meniscus until it reaches a point at which the orifice is less than half-full, as shown in FIG. 8, after which the positive pressure pulse applied during the time period 31 directs the ink flow in the outward direction at a very high rate until the drop is ejected at the end of that time period, after which the ink flows away from the end of the orifice during the time period 32. The negative pressure spike 33 assures that the ink drop will be ejected by separation from the meniscus in the orifice precisely at the beginning of the time period 32, assuring uniform drop size and accurate drop placement as the head scans adjacent to the substrate. Moreover, because the variable orifice impedance characteristic is utilized, the maximum rate of drop ejection is not limited by the relation between the surface tension of the ink and orifice radius and may be many times the maximum rate based upon constant orifice impedance assumptions, as described above.

Figure 9:
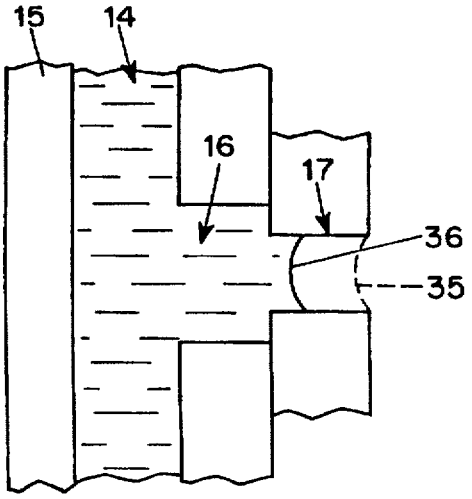
FIG. 9 is an enlarged fragmentary illustration of an ink jet orifice showing the location of the ink meniscus just prior to drop ejection in an arrangement utilizing variable orifice impedance characteristics for high-frequency operation.

Thus, in contrast to the drop ejection arrangement shown in FIG. 2, in which the meniscus 25 is at the outer end of the orifice when the ink drop is ejected, by utilizing a drop ejection pulse of the type described above, the ink meniscus, as shown in FIG. 9, is initially withdrawn from a location 35 at the outer end of the orifice 17 to an interior location 36 toward the opposite end of the orifice for drop ejection at which the impedance to ink flow is substantially reduced, permitting high maximum drop ejection rates of, for example, from 10 to 30 kHz up to 150 to 200 kHz.

Figure 10:
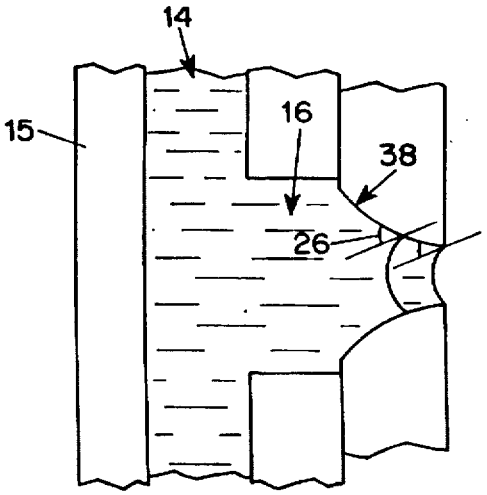
FIG. 10 is an enlarged fragmentary view similar to FIG. 2 illustrating the positions of the ink meniscus before and after drop ejection in a bellmouth orifice arrangement providing a variable impedance characteristic for high-frequency operation.

By utilizing an orifice with a tapered shape such as a bellmouth-shaped orifice 38 in which the diameter of the meniscus increases as the meniscus is retracted into the orifice, as shown in FIG. 10, an improvement in maximum drop ejection rate can be achieved since, in this case, the variable impedance characteristic of the orifice to ink flow is augmented by the design of the orifice. In this way, the improvement provided by utilizing a variable impedance characteristic can be enhanced by combining the tapered orifice structure shown in FIG. 10 with a pulse shape of the general type shown in FIG. 6, in which a negative pressure pulse precedes a positive pulse of greater magnitude.

Although the invention has been described herein with reference to specific embodiments, many modifications and variations therein will readily occur to those skilled in the art. Accordingly, all such variations and modifications are included within the intended scope of the invention.

I claim:

1. A method for ejecting hot melt ink drops at a high rate from an ink jet head having an orifice plate with an orifice to which ink is supplied from a reservoir comprising applying pressure pulses to hot melt ink having a meniscus within the orifice to eject ink drops utilizing a variable orifice impedance characteristic including initiating, when the orifice impedance is high, a first negative pressure pulse portion having an absolute magnitude which decreases during its duration to retract the meniscus to a controlled retract position within the orifice, when the orifice impedance is high, then generating, when the orifice impedance is low, a positive pressure pulse portion having an absolute magnitude which decreases during its duration to initiate ejection of an ink drop and then generating a second negative pressure pulse portion, having a peak to facilitate separation of an ink drop from the meniscus at a predetermined time, whereby the low orifice impedance during drop ejection permits higher drop ejection rates exceeding 20 kHz and the separation of each ink drop from the meniscus at the predetermined time contributes to uniform drop size and accurate drop placement.

2. A method according to claim 1 wherein the first negative pressure pulse portion withdraws the ink meniscus from a region adjacent to the outer end of the orifice into the interior of the orifice, and the succeeding positive pressure pulse portion is of greater absolute magnitude than the first negative pressure pulse portion.

3. A method according to claim 1 wherein the peak in the second negative pressure pulse portion occurs immediately after the positive pressure pulse portion.

4. A method according to claim 1 in which the absolute magnitude of the maximum value of the positive pressure pulse portion is approximately twice that of the first negative pressure pulse portion.

5. A method according to claim 1 in which the negative and positive pressure pulse portions have approximately equal duration.

6. A method according to claim 1 wherein the ink drop is ejected from an orifice having a tapered shape arranged to augment a variable orifice impedance characteristic.

7. A method according to claim 2 wherein the ink drop is ejected from an orifice having a tapered shape arranged to augment a variable orifice impedance characteristic.

8. A method according to claim 1 wherein the maximum drop ejection rate is in the range from 20–200 kHz.

9. An ink jet system for ejecting hot melt ink drops at a high maximum rate comprising a reservoir, an orifice plate having an orifice, an ink supply conduit for supplying ink from the reservoir to the orifice to produce an ink meniscus in the orifice, a transducer for applying pressure pulses to the ink in the orifice to eject ink drops utilizing a variable orifice impedance characteristic and actuator means for actuating the transducer to generate pressure pulses, wherein each pressure pulse includes a first negative pressure pulse portion having an absolute magnitude which decreases during its duration to retract the meniscus to a controlled retracted position within the orifice when the orifice impedance is high followed by a positive pressure pulse portion having an absolute magnitude which decreases during its duration to initiate ejection of an ink drop when the orifice impedance is low followed by a second negative pressure pulse portion having a peak to facilitate separation of an ink drop from the meniscus at a predetermined time, whereby the low orifice impedance during drop ejection permits higher drop ejection rates exceeding 20 kHz and the separation of each ink drop from the meniscus at a predetermined time contributes to uniform drop size and accurate drop placement.

10. An ink jet system according to claim 9 wherein the positive pressure pulse portion has a greater absolute magnitude than the first negative pressure pulse portion.

11. An ink jet system according to claim 9 wherein the actuating means for the transducer arranged to produce the peak in the second negative pressure pulse portion immediately following the positive pressure pulse portion.

12. An ink jet system according to claim 9 wherein the actuating means for the transducer produces a positive pressure pulse portion having a maximum absolute amplitude which is approximately twice the maximum absolute amplitude of the first negative pressure pulse portion.

13. An ink jet system according to claim 9 wherein the orifice has a tapered shape with decreasing diameter in the direction toward the outer end of the orifice arranged to augment the nonlinear orifice impedance characteristic.

14. An ink jet system according to claim 9 wherein the transducer is arranged to apply pulses to eject ink drops from the orifice at a maximum rate in the range from 20 to 200 kHz.

* * * * *